US008448371B1

(12) United States Patent
Wilhelm

(10) Patent No.: US 8,448,371 B1
(45) Date of Patent: May 28, 2013

(54) SHOTGUN MAGAZINE WEIGHT

(76) Inventor: Michael Brian Wilhelm, Lodi, NY (US)

( * ) Notice: Subject to any disclaimer, the term of this patent is extended or adjusted under 35 U.S.C. 154(b) by 0 days.

(21) Appl. No.: 13/546,410

(22) Filed: Jul. 11, 2012

(51) Int. Cl.
*F41C 27/00* (2006.01)

(52) U.S. Cl.
USPC ..... 42/97

(58) Field of Classification Search
USPC ..... 42/97, 90, 106, 49.02
See application file for complete search history.

(56) References Cited

U.S. PATENT DOCUMENTS 2,402,086 A * 6/1946 Rix ..... 42/75.02
2,635,378 A * 4/1953 Pinckney et al. ..... 42/49.02
3,371,440 A * 3/1968 Cassell ..... 42/49.02
3,604,136 A * 9/1971 Edwards ..... 42/97
3,650,060 A * 3/1972 Schubert ..... 42/1.06
4,310,982 A * 1/1982 Kast et al. ..... 42/75.02
4,492,050 A * 1/1985 Kagehiro ..... 42/1.06
4,602,449 A * 7/1986 Holmes ..... 42/49.02

* cited by examiner

*Primary Examiner* — Jonathan C Weber

(57) ABSTRACT

A weight for the tubular magazine of Remington model 870, 1100, and 11-87 shotguns. The main body has two longitudinal channels which prevent the weight from turning. The collar has a rim which fits against the end of a magazine tube. The collar has 24 teeth which intermesh with teeth in a magazine cap, which prevents the cap from coming loose when shooting. The collar has a recess in the center, to accept the inside part of a magazine cap sling swivel. The smallest diameter section holds the magazine spring in place. The magazine weight is compatable with Remington shotguns manufactured prior to the use of the magazine spring retainer and cap detent system. The invention adds weight to a shotgun to reduce felt or perceived recoil.

5 Claims, 2 Drawing Sheets

SHOTGUN MAGAZINE WEIGHT

BACKGROUND OF THE INVENTION

The present invention relates to firearms and more specifically to slide action (pump) and autoloading shotguns. All centerfire firearms produce recoil, which has been a concern for both competitive shooters and hunters. Shotguns larger than 410 and 28 gauge produce significant recoil typically causing "flinching", loss of correct shooting technique, and shoulder fatigue; with a decrease in marksmanship. This is especially true for skeet, trap, five stand, and sporting clays shooters, who may shoot 50, 75, 100, or more shells in a single day.

Shotgun target (clay pigeon) shooters use various accessories with their shotguns to reduce recoil. Recoil pads, muzzle brakes, barrel porting, mercury recoil suppressors, choke tubes with porting, etc. are examples of accessories.

It is common knowledge among competitive shooters and hunters that heavier shotguns have less recoil "kick" than lighter shotguns using the same ammunition. Weights have been added to shotguns by target shooters to reduce recoil and to change the balance of the gun. This shotgun magazine weight invention was specifically designed and made for Remington model 870, 1100, and 11-87 shotguns, for the purpose of adding weight to reduce felt or perceived recoil.

Related art consists of U.S. Pat. No. 2,635,378 to George E. Pinckney and Philip R. Haskell for a magazine plug for firearms. Their invention was made of a steel rod placed in a magazine tube which reduced magazine capacity for federal migratory bird hunting. It also added weight to a shotgun for more favorable recoil characteristics.

Related art includes U.S. Pat. No. 4,310,982 to Jack L. Kast and Edgar J. Young for their invention of a magazine spring retainer and cap detent system. Their invention had the dual function of retaining the magazine spring in the magazine tube and to keep the magazine cap securely tightened.

More related art includes U.S. Pat. No. 3,650,060 to Donald R. Schubert for his inertial recoil reducer for magazine firearms which includes a weighted piston interposed between a cushioned magazine follower and the magazine spring. That invention was to reduce the recoil of the gun.

Other related art includes U.S. Pat. No. 3,604,136 to Jesse B. Edwards for his invention of a shotgun counterbalance. His counterbalance invention included at least one weight on a threaded shaft below a shotgun barrel to compensate for any imbalances within the shotgun by distribution of weights.

Additional related art includes U.S. Pat. No. 4,492,050 to Ken Kagehiro for his invention of a shotgun recoil reducer. His recoil reducer consists of a cylinder tube with a slidable weighted piston assembly attached to the end of a magazine tube. Pressurized gases from the gun barrel push the piston assembly rearward against the spring, causing the gun to recoil forward partially offsetting the rearward recoil.

BRIEF SUMMARY OF THE INVENTION

This invention consists of an accessory for a Remington model 870, 1100, and 11-87 shotgun for the primary purpose to add weight to reduce felt or perceived recoil. Secondary purposes are to keep the magazine spring centered in the magazine tube and to keep the magazine cap from coming loose while shooting. The one piece part made of stainless steel, steel, or other metal, fills the diameter of a magazine tube. The two longitudinal channels slide over the two indents in a magazine tube, and prevent the weight from moving sideways. The smallest diameter part of the weight keeps the magazine spring centered in the magazine tube. The widest diameter part (collar rim) fits against the end of the magazine tube, and with the magazine cap in place, prevents the part from moving forward or backward. The 24 teeth in the end of the weight intermesh with teeth on the inside of the magazine cap, and prevent the magazine cap from coming loose while shooting. The recess in the larger end of the weight is compatable with magazine caps that have factory installed sling swivels. The Remington magazine spring retainer is not used when this accessory is used.

DETAILED DESCRIPTION OF THE INVENTION

Figure 1:
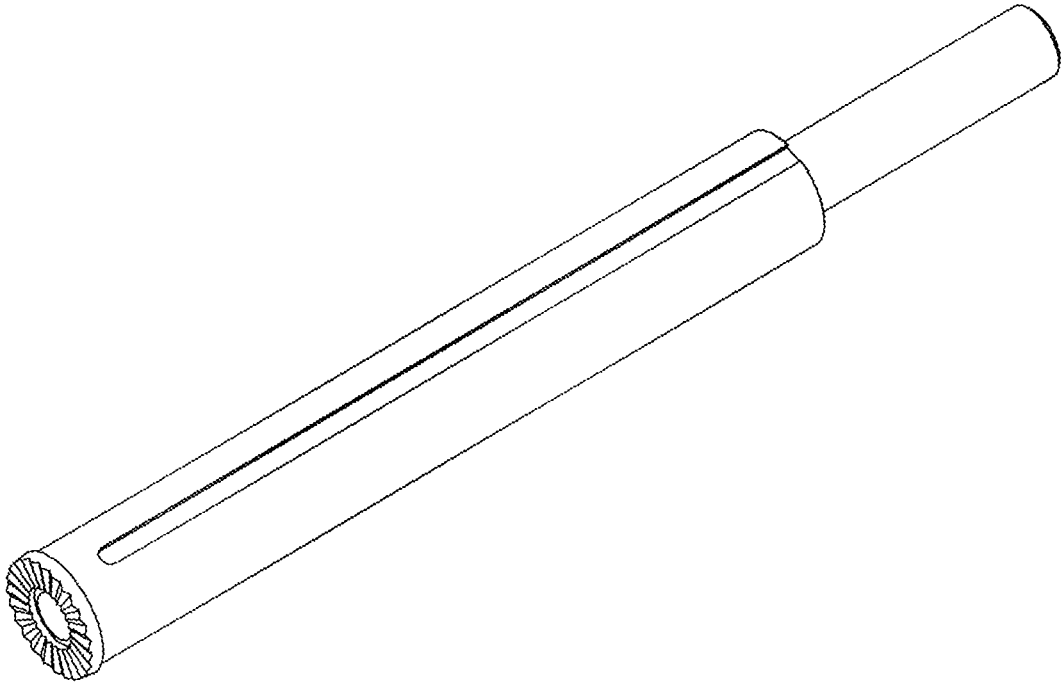
FIG. 1 is a 3D view of the shotgun magazine weight.
Figure 2:
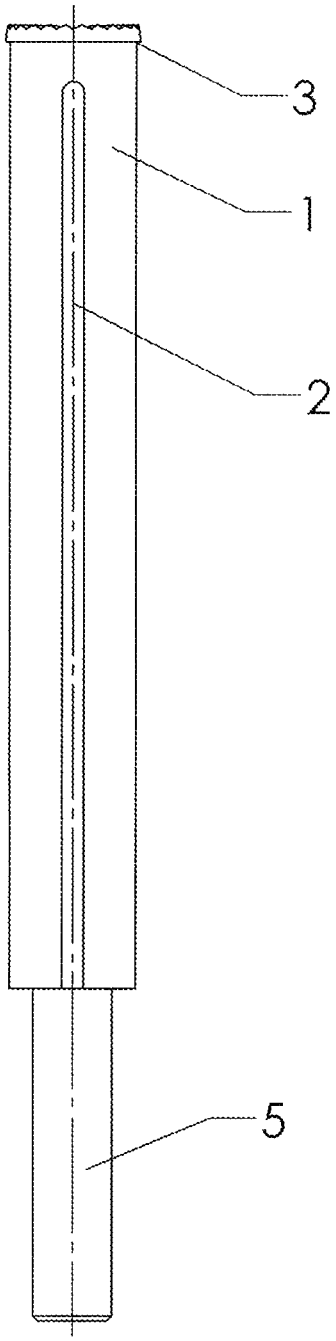
FIG. 2 is a plan view of the invention.
Figure 3:
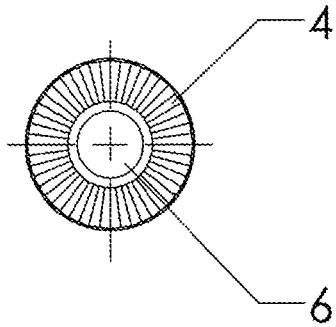
FIG. 3 is a cross section of the widest part, the collar.
Figure 4:
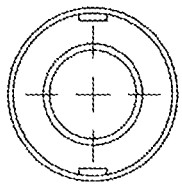
FIG. 4 is a cross section of the smallest diameter end.

This one piece part made of stainless steel, steel, or other metal, fits in the front end of a magazine tube of a Remington model 870, 1100, and 11-87 shotgun. The weight is made to be compatable with adjacent parts such as the magazine tube, the magazine spring, and the magazine cap. The weight replaces the magazine spring retainer when the weight is used. The invention is put in the magazine tube from the front end after removing the magazine spring retainer. The main body of the weight shown in FIG. 2 reference 1 completely fills the diameter of a magazine tube. The two longitudinal channels FIG. 2 reference 2 slide over the indents of a magazine tube, and prevent the weight from turning. The collar FIG. 2 reference 3 fits against the end of the magazine tube, preventing forward and backward movement when the magazine cap is in place. The widest part, the collar FIG. 3 reference 4 has 24 teeth which intermesh with the teeth of a Remington magazine cap, and prevent the cap from coming loose when shooting. The edge of the collar has a slight taper to prevent it from catching on the threads of a magazine cap. The collar has a recess in the center FIG. 3 reference 6 which accepts the inside part of a sling swivel attached to a magazine cap. The smallest diameter section FIG. 2 reference 5 holds the magazine spring centered in the magazine tube. FIG. 4 is a cross section of the smallest diameter end, showing the two longitudinal channels, the rim on the collar, and the chamfer on the end which prevents the magazine spring from binding on the weight.

For a 12 ga. shotgun, for example, the weight is approx. 20 ounces, approx. 9.0 inches long, and approx. 0.96 inches dia. at the widest point. The part can be made shorter to reduce the weight of the invention. For smaller gauge shotguns, the dimensions are smaller. When this accessory is used, magazine capacity is reduced to 1 shell plus 1 shell in the chamber, for a total of 2 shots. The invention can be removed from the shotgun whenever the extra weight is not wanted.

I claim:

1. A magazine weight for a shotgun to reduce felt or perceived recoil, comprising: a cylinder having a first section and a second section, the first section having a first diameter and the second section having a second diameter, the second diameter being smaller than the first diameter and sized to allow a magazine spring to be located thereon, two longitudinal channels located on the first section designed to slide over the indents of a magazine tube to prevent rotation of the magazine weight, a rim located on the end of the first section distal to the second section having a third diameter that is greater than the first diameter designed to engage the opening of the magazine tube and prevent the weight from moving longitudinally in the magazine tube, and teeth located on the surface of the rim distal to the cylinder, designed to intermesh with corresponding teeth in a magazine cap.

2. The magazine weight of claim 1, wherein the overall length of the magazine weight is less than 9 inches and the weight is less than 20 ounces.

3. The magazine weight of claim 1, wherein the collar has a recess to accommodate magazine caps that have sling swivels.

4. The magazine weight of claim 1, further comprising a chamfer on the smallest diameter section distal to the first section to prevent the magazine spring from binding on the magazine weight.

5. The magazine weight of claim 1, further comprising a slight taper on the rim of the collar distal to the second section, designed to prevent the magazine cap threads from catching on the collar.

* * * * *